US008083229B2

(12) United States Patent
Chatte et al.

(10) Patent No.: US 8,083,229 B2
(45) Date of Patent: Dec. 27, 2011

(54) MAILPIECE FEED DEVICE

(75) Inventors: Fabien Chatte, Nogent sur Marne (FR); Romain Pillard, Avon (FR)

(73) Assignee: Neopost Technologies, Bagneux (FR)

( * ) Notice: Subject to any disclaimer, the term of this patent is extended or adjusted under 35 U.S.C. 154(b) by 0 days.

(21) Appl. No.: 12/635,408

(22) Filed: Dec. 10, 2009

(65) Prior Publication Data

US 2010/0156030 A1 Jun. 24, 2010

(30) Foreign Application Priority Data

Dec. 19, 2008 (FR) ..... 08 58870

(51) Int. Cl.
*B65H 5/34* (2006.01)

(52) U.S. Cl. ..... 271/270; 271/114; 271/110; 271/111; 271/35; 271/23

(58) Field of Classification Search ..... 271/23, 271/35, 110, 111, 270, 114
See application file for complete search history.

(56) References Cited

U.S. PATENT DOCUMENTS

| | | | | |
|---|---|---|---|---|
| 4,753,432 | A * | 6/1988 | Freeman | 271/35 |
| 4,787,620 | A * | 11/1988 | Goldkuhle | 271/111 |
| 4,953,842 | A * | 9/1990 | Tolmie et al. | 271/2 |
| 5,240,241 | A * | 8/1993 | Kawazoe | 271/114 |
| 5,498,114 | A * | 3/1996 | Gregoire et al. | 414/21 |
| 7,437,332 | B2 * | 10/2008 | Jacobson et al. | 705/407 |
| 2002/0140158 | A1 | 10/2002 | Jaeger et al. | |
| 2008/0006985 | A1 * | 1/2008 | Kuse | 271/110 |

FOREIGN PATENT DOCUMENTS

| | | |
|---|---|---|
| EP | 0 906 881 A1 | 4/1999 |
| FR | 2 872 612 A | 1/2006 |

* cited by examiner

*Primary Examiner* — Kaitlin Joerger
*Assistant Examiner* — Prasad Gokhale
(74) *Attorney, Agent, or Firm* — Sughrue Mion, PLLC

(57) ABSTRACT

In a mailpiece feed device comprising a mailpiece-receiving deck through which motor-driven conveyor members pass and on which a stack of mailpieces stands, and a monitoring and control circuit for actuating said motor-driven members at a determined drive speed in order to enable said mailpieces to be extracted one-by-one downstream, there is provided a method of controlling said motor-driven conveyor members wherein the drive speed of said motor-driven conveyor members varies as a function of the weight of said stack of mailpieces standing on said mailpiece-receiving deck.

6 Claims, 3 Drawing Sheets

MAILPIECE FEED DEVICE

FIELD OF THE INVENTION

The present invention relates to the specific field of mail handling. It relates more particularly to an improved mailpiece feed device for feeding mailpieces into a franking machine or "postage meter" that optionally incorporates a differential weigh module.

PRIOR ART

Differential weigh modules designed to be implemented with franking machines are well known. Such a device weighs on the fly and includes a weigh deck (forming a mailpiece-receiving magazine) that incorporates a load sensor and on which a stack of mailpieces stands. For weighing purposes, the operator removes the mailpieces one-by-one, and the difference in weight measured by the scales before and after a mailpiece is removed is transmitted to the franking machine that then determines the franking value while said mailpiece is being transferred from the weigh module towards the franking machine.

Patent FR 2 872 612 filed in the name of the Applicant also discloses an automatic mailpiece feed device incorporating such a differential weigh module and thus making continuous weighing possible, thereby enabling mailpieces to be fed in at particularly high rates. That device is generally satisfactory. However, the inventors have observed that the force exerted on the mailpieces can vary considerably from one mailpiece to another, and in particular between the first and the last mailpieces in the stack, and that, as a result, either two mailpieces might go through together, or unnecessary energy might be expended for overcoming the weight of the stack.

That drawback is also present in more conventional feed devices where the mailpieces are weighed in an external weigh device.

OBJECT AND DEFINITION OF THE INVENTION

The invention proposes to mitigate that drawback with an improved mailpiece feed device that optionally incorporates a differential weigh module and in which the force exerted on each of the mailpieces is adapted to the weight of the stack of mailpieces throughout processing thereof, so as to deliver a feed rate that is constant. An object of the invention is also to maintain the force constant regardless of the environment to which the feed device is subjected.

In a mailpiece feed device comprising a mailpiece-receiving deck through which motor-driven conveyor members pass and on which a stack of mailpieces stands, and a monitoring and control circuit for actuating said motor-driven members at a determined drive speed in order to enable said mailpieces to be extracted one-by-one downstream, these objects are achieved by a method of controlling said motor-driven conveyor members wherein the drive speed of said motor-driven conveyor members varies as a function of the weight of said stack of mailpieces standing on said mailpiece-receiving deck.

Thus, with this method implemented in an improved feed device, the drive speed of the motor-driven conveyor members is constantly matched to the weight of the stack of mailpieces, and it is thus possible to avoid two mailpieces going through together.

Depending on the implementation, said weight of said stack of mailpieces may be obtained either from a weigh device that is external to the feed device, and then communicated to said monitoring and control circuit, or else from a weigh unit that carries said mailpiece-receiving deck and said motor-driven conveyor members, and that is connected to said monitoring and control circuit.

Preferably, said variation in speed is linear, the drive speed of said motor-driven conveyor members being maximum when said stack of mailpieces is heaviest, and then decreasing as said stack of mailpieces decreases.

Advantageously, said drive speed of said motor-driven conveyor members also varies as a function of the humidity measured in the feed device by a humidity sensor. Preferably, said variation in speed is linear, the drive speed of said motor-driven conveyor members increasing when said humidity increases and vice versa.

The invention also provides a mailpiece feed device comprising a mailpiece-receiving deck through which motor-driven conveyor members pass and on which a stack of mailpieces stands, and a monitoring and control circuit for actuating said motor-driven members at a determined drive speed in order to enable said mailpieces to be extracted one-by-one downstream, wherein said monitoring and control circuit is adapted to cause said drive speed of said motor-driven conveyor members to vary as a function of the weight of said stack of mailpieces standing on said mailpiece-receiving deck.

Depending on the embodiment, said weight of said stack of mailpieces may be obtained either from a weigh device that is external to the feed device, and then communicated to said monitoring and control circuit, or from a weigh unit that carries said mailpiece-receiving deck and said motor-driven conveyor members, and that delivers a weigh signal that is proportional to the weight of said stack of mailpieces.

The feed device may further comprise a humidity sensor for delivering to said monitoring and control circuit a value for the humidity measured in said feed device, and said monitoring and control circuit is adapted also to cause said drive speed of said motor-driven conveyor members to vary as a function of said measured humidity value.

BRIEF DESCRIPTION OF THE DRAWINGS

Other characteristics and advantages of the present invention appear more clearly from the following description given by way of non-limiting indication, and with reference to the accompanying drawings, in which.

DETAILED DESCRIPTION OF A PREFERRED EMBODIMENT

Figure 1:
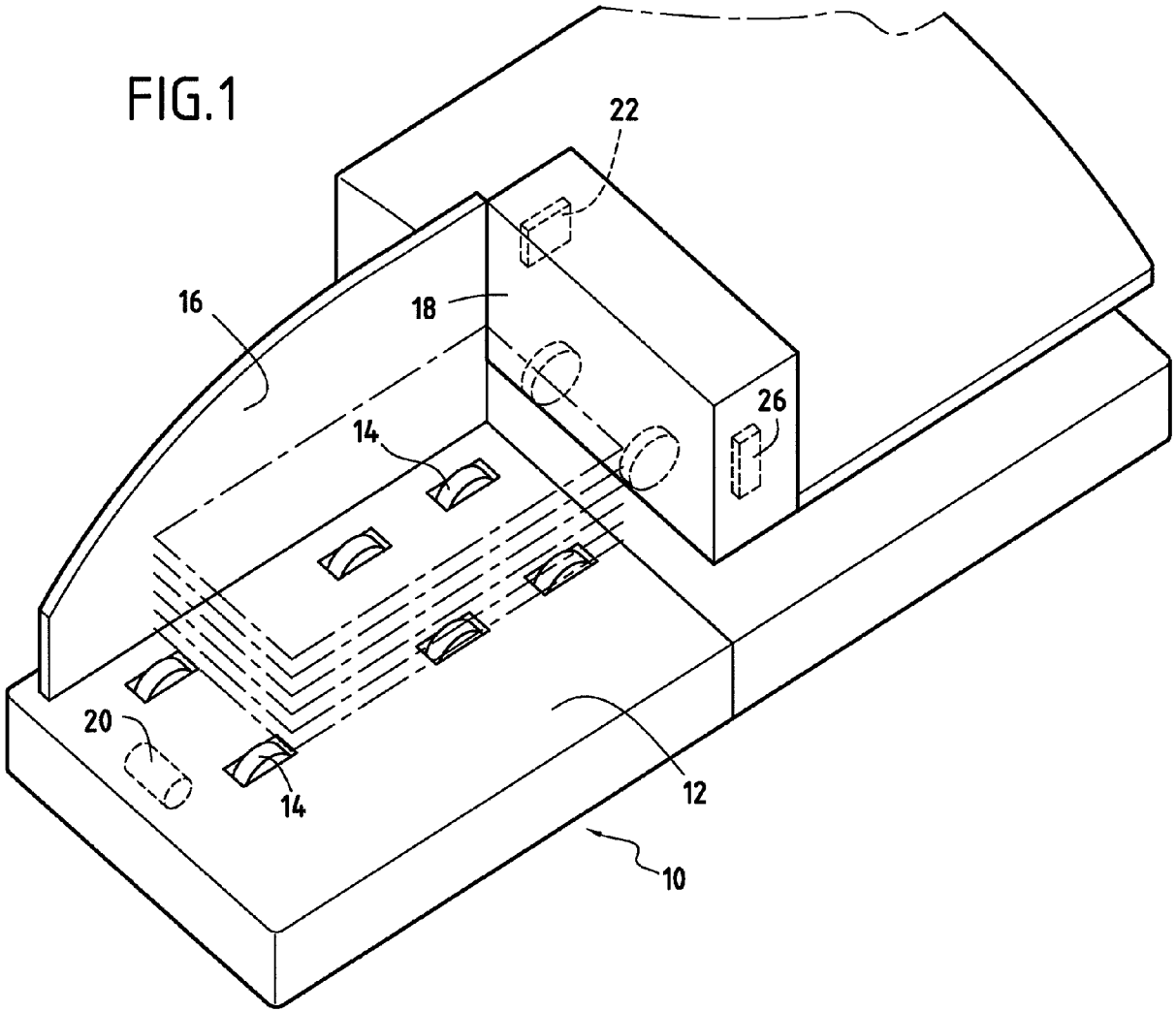
FIG. 1 is a perspective view of an embodiment of a feeder of the invention for a mail-handling machine.

FIG. 1 shows a first embodiment of a mailpiece feed module 10 to which the method of the invention can be applied and that is designed to be placed, as is known, at the inlet of a franking module for franking the mailpieces (the franking machine proper not being shown).

This feed device conventionally includes a mailpiece-receiving deck 12 through which motor-driven conveyor members 14 pass, which members can be constituted by motor-driven wheels, by motor-driven rollers, or indeed by motor-driven conveyor belts. The stack of mailpieces to be franked stands on the deck, and said conveyor members make it possible to convey and to eject the mailpieces towards the franking module that is disposed downstream. Naturally, the mailpiece-receiving deck incorporates at least one longitudinal referencing wall 16 and a transverse wall 18 for positioning the mailpieces.

The motor-driven conveyor means are actuated conventionally at a determined drive speed by a common drive motor 20, advantageously of the DC electric type, as a function of monitoring and control means 22, preferably having a microprocessor and associated software. It should be noted that said monitoring and control means are not necessarily incorporated into the feed device, but rather they can be constituted merely by the processor means of the franking module to which the feed module is commonly connected via an electrical link.

Figure 2:
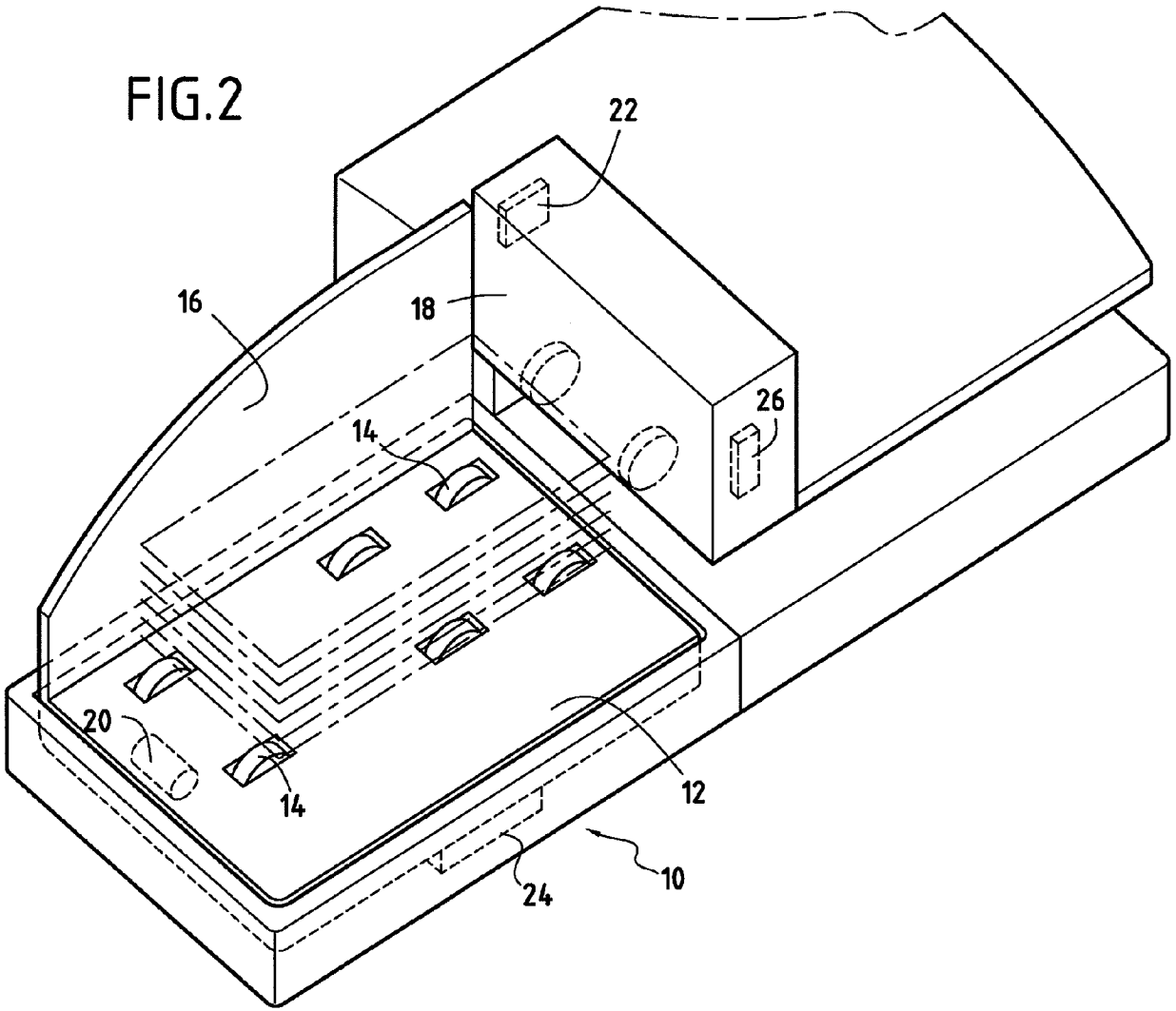
FIG. 2 is a perspective view of an embodiment of a feeder of the invention incorporating a differential weigh module for a mail-handling machine.

FIG. 2 shows another example of a mailpiece feed module incorporating a differential weigh module so as to form a single device also designed to be disposed at the inlet of the franking machine for franking the mailpieces.

The feed device also includes the mailpiece-receiving deck 12 on which the stack of mailpieces stands and through which the motor-driven conveyor members 14 pass that are designed to convey and eject the mailpieces towards the franking module once the weighing has been performed. The mailpiece-receiving deck incorporates the longitudinal referencing wall 16 and the transverse wall 18 for positioning the mailpieces accurately with a view to them being weighed using the known process of differential weighing by means of a weigh unit 24 (conventionally of the type having load sensors, such as strain gauges) disposed under the mailpiece-receiving deck 12 that it carries together with the motor-driven conveyor members.

The motor-driven conveyor members are conventionally actuated at a determined drive speed by the common drive motor 20, which is advantageously of the DC electric type, as a function of monitoring and control means 22, which preferably have a microprocessor and associated software, and which also manage the weight data delivered by a weigh signal from the weigh unit. It should be noted, as above, that said monitoring and control means are not necessarily incorporated in the feed device but can be constituted simply by the processor means of the franking module to which means the feed module is connected via an electrical link.

As is known, the weigh module can also include format detection means (not shown) that are connected to the monitoring and control means and that enable it to deliver data relating to the length and the width of said mailpiece, i.e. to the format of the mailpiece. In certain countries like the United States, Germany, or Great Britain, the format of a mailpiece, in the same way as its weight, is a component entering into the computation of the franking amount. It should however be noted that said format detection means can also be disposed in the franking module.

In the invention, the monitoring and control circuit 22 is adapted to cause the speed at which the motor-driven conveyor members 14 are driven to vary as a function of the weight of the stack of mailpieces standing on the mailpiece-receiving deck 12. The weight of the stack of mailpieces can be obtained in the feed device of FIG. 1 from a weigh device (not shown) that is external to said feed device and that then communicates the measured weight value to the monitoring and control circuit 22. But said weight of the stack of mailpieces can also be delivered directly by the feed device when, as shown in the feed device of FIG. 2, said feed device includes an integrated weigh unit 24 that carries both the mailpiece-receiving deck 12 and the motor-driven conveyor members, and thus that delivers a weigh signal that is proportional to the weight of said stack of mailpieces.

In an advantageous variant, the feed device that can optionally incorporate a weigh module can further include a humidity sensor 26 for delivering to the monitoring and control circuit 22 a value for the humidity measured in the feed device in order to enable said monitoring and control circuit to cause the drive speed of the motor-driven conveyor members 14 to vary as a function of the measured humidity value. When the humidity is high (e.g. greater than 80%), the coefficients of friction of the mailpieces, between one another, with the mailpiece-receiving deck, or indeed with the motor-driven conveyor members with which they are in contact, are increased, thereby requiring the drive speed of said members to be increased in proportion in order to guarantee that the mailpieces are separated properly and in order to maintain a constant extraction rate.

Figure 3:
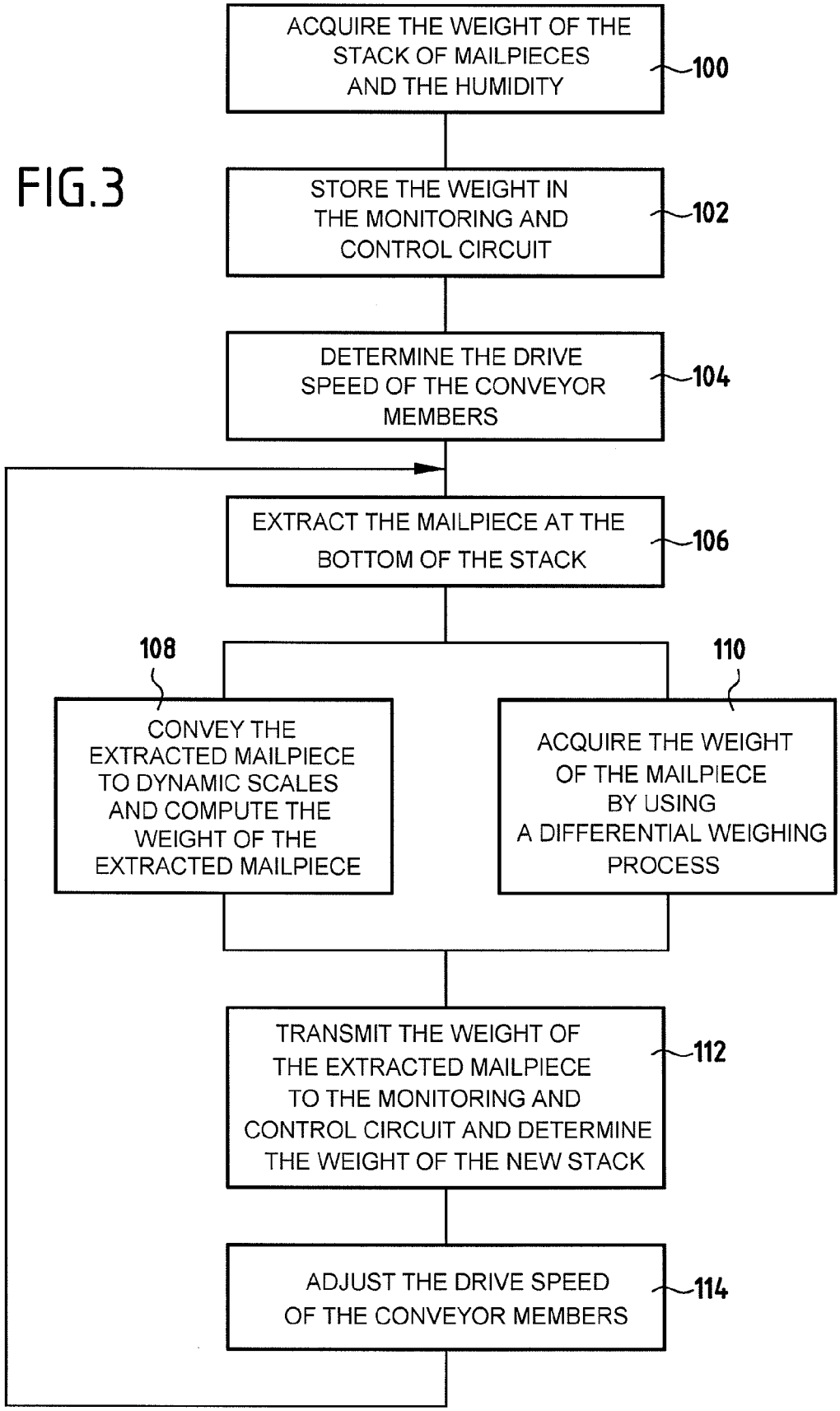
FIG. 3 is a flow chart showing the method of controlling the motor-driven conveyor members of the feeders of FIGS. 1 and 2.

The method implemented in the above-mentioned feed devices is explained below with reference to the flow chart of FIG. 3.

In a first step 100, the weight of the stack of mailpieces loaded on the mailpiece-receiving deck of the improved feed device of the invention is acquired, it being possible for this acquisition to result from the differential weighing process that is specific to the feed device itself or from a weight value being communicated that is obtained by an external weigh device connected to the franking module to which the feed device is itself connected. Optionally, this acquisition step can also include acquisition of the humidity in the device by the humidity sensor 26.

The weight obtained in this way and corresponding to the weight of the stack of mailpieces is then put in a memory in the monitoring and control circuit, in a step 102, and, in a following step 104, the drive speed of the motor-driven drive members is set by the monitoring and processing circuit as a function of said weight and optionally of the humidity measured, the maximum speed corresponding to the heaviest (and thus in general the tallest) stack that is acceptable for the mailpiece-receiving deck.

Once said drive speed has been determined, the mailpiece at the bottom of the stack can then be extracted in a step 106 and, depending on the feed device being used, in a following step 108, said mailpiece is transferred to dynamic scales that compute the weight thereof (for a standard feed device) or, in a parallel step 110, the weight of the extracted mailpiece is computed and acquired by subtracting from the previously memorized weight of the initial stack of mailpieces the weight of the new stack once the mailpiece has been extracted (for a feed device incorporating a weigh unit). In a following step 112, the weight of the mailpiece is then transmitted to the monitoring and control circuit so as to update the weight of the stack and so as to adjust the drive speed of the transport members in a following step 114 if necessary. Finally, it is possible to loop back to step 106 in order to extract a new mailpiece and in order to resume the above-mentioned process of computing the weight of the new stack and of adjusting the drive speed of the conveyor members.

Thus, since the weight of the stack of mailpieces is known at all times, it is possible to adjust, in real time, the speed at which the conveyor members are driven, and thus to take account of the weight of said stack that influences the forces required of said members for extracting said mailpieces one after another. It should also be noted that although mention is made of only one measurement of humidity during the initial acquisition of the weight of the stack of mailpieces, naturally it is quite possible for that measurement to be taken more frequently.

What is claimed is:

1. In a mailpiece feed device comprising a mailpiece-receiving deck through which motor-driven conveyor members pass and on which a stack of mailpieces stands, and a monitoring and control circuit for actuating said motor-driven members at a determined drive speed in order to enable said mailpieces to be extracted one-by-one downstream, a method of controlling said motor-driven conveyor members wherein the drive speed of said motor-driven conveyor members varies as a function of the weight of said stack of mailpieces standing on said mailpiece-receiving deck, wherein said variation is linear, the drive speed of said motor-driven conveyor members being maximum when said stack of mailpieces is heaviest, and then decreasing as said stack of mailpieces decreases.

2. A method according to claim 1, wherein said weight of said stack of mailpieces is obtained from a weigh unit that carries said mailpiece-receiving deck and said motor-driven conveyor members, and that is connected to said monitoring and control circuit.

3. A method according to claim 1, wherein said drive speed of said motor-driven conveyor members also varies as a function of the humidity measured in the feed device by a humidity sensor.

4. A method according to claim 3, wherein said variation in speed is linear, the drive speed of said motor-driven conveyor members increasing when said humidity increases and vice versa.

5. A mailpiece feed device comprising a mailpiece-receiving deck through which motor-driven conveyor members pass and on which a stack of mailpieces stands, and a monitoring and control circuit for actuating said motor-driven members at a determined drive speed in order to enable said mailpieces to be extracted one-by-one downstream, wherein said monitoring and control circuit is adapted to cause said drive speed of said motor-driven conveyor members to vary as a function of the weight of said stack of mailpieces standing on said mailpiece-receiving deck, further comprising a humidity sensor for delivering to said monitoring and control circuit a value for the humidity measured in said feed device, and wherein said monitoring and control circuit is adapted also to cause said drive speed of said motor-driven conveyor members to vary as a function of said measured humidity value.

6. A device according to claim 5, wherein said mailpiece-receiving deck and said motor-driven conveyor members are carried by a weigh unit that delivers a weigh signal that is proportional to the weight of said stack of mailpieces.

* * * * *